US009170049B2

(12) United States Patent
Fissore et al.

(10) Patent No.: US 9,170,049 B2
(45) Date of Patent: Oct. 27, 2015

(54) METHOD FOR MONITORING PRIMARY DRYING OF A FREEZE-DRYING PROCESS

(75) Inventors: Davide Fissore, Bra (IT); Roberto Pisano, Moretta (IT); Antonello A. Barresi, Collegno (IT)

(73) Assignee: Azbil Telstar Technologies, S.L. (ES)

( * ) Notice: Subject to any disclaimer, the term of this patent is extended or adjusted under 35 U.S.C. 154(b) by 681 days.

(21) Appl. No.: 13/518,445

(22) PCT Filed: Dec. 22, 2010

(86) PCT No.: PCT/IB2010/056011

§ 371 (c)(1),
(2), (4) Date: Sep. 19, 2012

(87) PCT Pub. No.: WO2011/077390

PCT Pub. Date: Jun. 30, 2011

(65) Prior Publication Data

US 2013/0006546 A1 Jan. 3, 2013

(30) Foreign Application Priority Data

Dec. 23, 2009 (IT) ..... MO2009A0309

(51) Int. Cl.
*F26B 5/06* (2006.01)

(52) U.S. Cl.
CPC ..... *F26B 5/06* (2013.01)

(58) Field of Classification Search
CPC ..... F26B 5/00; F26B 5/04; F26B 5/06; F26B 7/00; F26B 9/00; F26B 19/00; F26B 21/00; G06F 19/00
USPC ..... 34/284, 287, 298; 165/65; 236/12.12
See application file for complete search history.

(56) References Cited

U.S. PATENT DOCUMENTS 2,994,132 A 8/1961 Neümann
3,192,643 A 7/1965 Rieutord
(Continued)

FOREIGN PATENT DOCUMENTS

EP 1903291 A1 * 3/2008 ..... F26B 5/06
EP 2148158 A1 * 1/2010 ..... F26B 5/06
(Continued)

OTHER PUBLICATIONS

Goff J. A., et al, "Low-pressure properties of water from -160 to 212 F," Transactions of the American Society of Heating and Ventilating Engineers, 1946, pp. 95-122, vol. 52, J.J. Little & Ives Co., New York.

*Primary Examiner* — Stephen M Gravini
(74) *Attorney, Agent, or Firm* — Laubscher Spendlove & Laubscher, P.C.

(57) ABSTRACT

A freeze-drying process includes a primary drying phase. Within this phase, a test is performed for causing a variation of partial pressure of solvent inside a drying chamber. At the beginning of the test, a product sublimation flux, a total pressure and a partial pressure of the solvent in the drying chamber are measured. A product temperature is estimated at the interface of sublimation at the beginning of the test. The solvent vapor pressure at the interface of sublimation is calculated as is a resistance of a dried layer of the product to the vapor flow of the solvent. Next, a thickness of a frozen layer of the product is calculated and a coefficient of heat transfer between heating surface and product is also calculated. An initial temperature profile of the frozen product is then calculated as is a total pressure in the drying chamber. A value of the product temperature at the interface of sublimation at the beginning of test is determined and a time constant of the freeze-drying process is calculated.

24 Claims, 5 Drawing Sheets

(56) References Cited

U.S. PATENT DOCUMENTS

Figure 1:
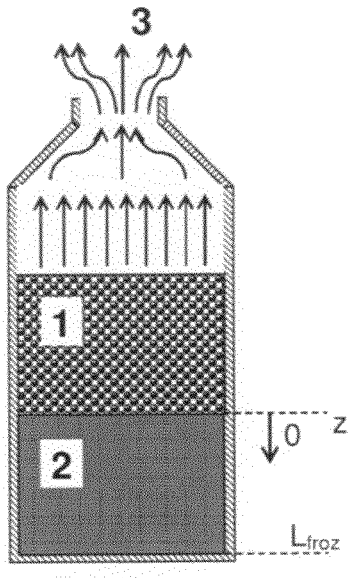

| | | | | |
|---|---|---|---|---|
| 3,266,169 | A * | 8/1966 | Smith, Jr. | 34/58 |
| 3,270,432 | A * | 9/1966 | Barbareschi | 34/92 |
| 4,780,964 | A | 11/1988 | Thompson | |
| 5,822,882 | A * | 10/1998 | Anger | 34/296 |
| 6,163,979 | A | 12/2000 | Oetjen et al. | |
| 6,226,997 | B1 | 5/2001 | Vago | |
| 6,643,950 | B2 | 11/2003 | Lambert et al. | |
| 6,971,187 | B1 * | 12/2005 | Pikal et al. | 34/285 |
| 7,954,254 | B2 * | 6/2011 | Bussmann et al. | 34/283 |
| 8,528,225 | B2 * | 9/2013 | Weisselberg | 34/284 |
| 8,689,460 | B2 * | 4/2014 | Kuu | 34/287 |
| 8,898,928 | B2 * | 12/2014 | Sirard et al. | 34/284 |
| 2003/0116027 | A1 * | 6/2003 | Brulls | 99/279 |
| 2006/0208191 | A1 | 9/2006 | Kessler et al. | |
| 2010/0018073 | A1 * | 1/2010 | Fissore et al. | 34/284 |
| 2013/0006546 | A1 * | 1/2013 | Fissore et al. | 702/50 |

FOREIGN PATENT DOCUMENTS

| | | | | |
|---|---|---|---|---|
| WO | 9530118 | A1 | 11/1995 | |
| WO | 2007115965 | A1 | 10/2007 | |
| WO | WO 2007116371 | A2 * | 10/2007 | G01K 1/02 |
| WO | 2008034855 | A2 | 3/2008 | |
| WO | 2008042408 | A2 | 4/2008 | |

* cited by examiner

METHOD FOR MONITORING PRIMARY DRYING OF A FREEZE-DRYING PROCESS

This application is a §371 National Stage Entry of PCT International Application No. PCT/IB2010/056011 filed Dec. 22, 2010. PCT/IB2010/056011 claims priority to IT Application No. MO2009A000309 filed Dec. 23, 2009. The entire contents of these applications are incorporated herein by reference.

The invention relates to methods for monitoring freeze-drying processes; in particular it refers to a method for monitoring the primary drying step of a freeze-drying process for freeze-drying products, for example pharmaceutical products, arranged in containers.

Freeze-drying is a process that enables to eliminate by sublimation of water and/or solvents from a substance, for example a food, a pharmaceutical or a biological product. Eliminating the water enables perishable products to be conserved as the action of microorganisms and enzymes, that would normally spoil or degrade the products, is inhibited; in the case of pharmaceutical products the process increases the stability of the products and generally makes easier the products storage. Further, the process makes the product more convenient for transport as the product becomes much more compact and light. As freeze-drying takes place at low temperatures, it is of particular interest for those products that would be damaged by the higher temperatures required by the other drying processes. Freeze-dried products can then be rehydrated or reconstituted easily and quickly by adding the removed water and/or solvents.

The apparatuses used for performing a freeze-drying process usually comprise a drying chamber and a condensation chamber connected by a conduit. The drying chamber comprises a plurality of shelves with temperature-controlled heatable surfaces arranged for receiving the containers (e.g. vials), or, possibly, the trays with the product to be freeze-dried. The condensation chamber comprises surfaces (condensation plates or windings) maintained at very low temperatures, generally below −50° C., by means of a refrigerant or freezing device. The condensation chamber is also connected to one or more vacuum pumps that suck the air (or other gas that may be present and is not condensable) such as to obtain a high vacuum value inside both chambers.

A freeze-drying process typically comprises three phases: a freezing phase, a primary drying phase in which sublimation of the solvent occurs, and a secondary drying phase in which the solvent that has not been sublimated is desorbed.

During the freezing phase, the temperature of the product is typically lowered to −30/−50° C. in order to convert into ice most of the water and/or solvents contained in the product. In the primary drying phase the product can also be heated up to 30-40° C., while the pressure inside the drying chamber is lowered to values that are usually within the 0.05-1 mbar range to allow the frozen water and/or solvents in the product to sublime, i.e. to pass directly from solid phase to gaseous phase. The use of high vacuum values makes it possible to sublime water at low temperatures.

Heat is transferred from the heating surface of the shelf to the bottom of the container and from here to the sublimation front, which is an interface between the frozen portion and the dried portion of the product. The sublimation front moves inwards the product from the upper part to the bottom of the container whilst the primary drying phase proceeds. The thickness of the dried portion of product increases progressively and this generates progressively increasing resistance to the flow of vapour from the sublimation surface to the chamber.

The sublimation of the frozen water and/or of the frozen solvents creates dried regions with a porous structure comprising a lattice of holes and slits for vapour to exit from the sublimation front to the exterior.

The vapour is removed from the drying chamber by means of the cooled surfaces in the condensation chamber in which the vapour can be re-solidified or frozen.

The secondary drying phase is provided for removing by desorption the amount of unfrozen water and/or solvents that cannot be removed by sublimation. During this phase, the temperature of the trays is further increased up to values that can also be greater than 30-60° C. to heat the product, while the pressure inside the drying chamber is usually set at a value below 0.1 mbar.

At the end of the secondary drying phase, the product is completely dried with residual moisture content generally comprised between 1 and 3%.

The freeze-dried product can be sealed in the containers to prevent re-adsorption of the moisture. In this manner, the product can normally be preserved at ambient temperature without refrigeration and is protected from deterioration for a long time.

As freeze-drying is a low temperature process, it causes less damage or degradation to the product than other high-temperature dehydration processes.

Further, freeze-dried products can be rehydrated much quickly and easily owing to the porous structure that is created during sublimation of the vapour.

In the pharmaceutical field, the freeze-drying process is widely used in the production of medicines that are mainly administered parenterally and orally, also because the freeze-drying process can be easily performed in sterile conditions.

During the freeze-drying process, the temperature of the product can be maintained below a limit value that is characteristic of the product. In the case of solutes that crystallise during freezing, the maximum permitted temperature corresponds to the eutectic point in order to avoid the formation of a liquid phase and subsequent boiling due to low pressure. In the case of solutes that remain amorphous during freezing, the maximum permitted temperature is near the glass transition temperature in order to avoid the collapse of the dried portion ("dried cake"). The collapse of the dried portion can cause a higher content of residual water in the final product, longer reconstitution time and a loss of activity of the pharmaceutical principle. Further, a collapsed product is often rejected due to an unattractive appearance.

The residual amount of frozen water must also be monitored during primary drying to detect the final point of this phase. If the secondary drying phase starts before the end of the preceding phase, the temperature of the product may exceed the maximum permitted value, this causing the frozen residue to melt or the dried portion to collapse. If the secondary drying phase is delayed, the cycle is not optimised and the cost of the process rises.

Monitoring primary drying is particularly difficult as it is not possible to measure in-line the temperature of the product and the residual water content without interfering with the dynamics of the freeze-drying process.

In addition to the temperature of the product and the residual water content, it is advisable to measure other parameters during primary drying, for example the value of the coefficient of heat transfer between the heating surface and container ($K_v$) that influences the flow of heat from the heating surface to the product, and the resistance of the dried layer to the vapour flow ($R_p$), which influences the vapour flow from the sublimation front to the drying chamber. These parameters are required if modern control instruments are used that enable the quality of the product to be assured and the process to be optimised.

The coefficient of heat transfer $K_v$ is a function of operating conditions (temperature of the heating surface, pressure of the drying chamber and composition of the atmosphere in the chamber), of the type of container and of the contact between the container and shelf and the value thereof can also be calculated preliminary, for example on the basis of the results obtained by a suitable experimental research. However, this experimental research must be conducted each time that the container is changed and even if certain details are modified such as production specifications or tolerances.

Further, the experimental research does not generally take into account the radiation of the walls and above all of other details such as the presence of frames and trays unless it has been conducted in the same conditions and in the same apparatus that will then be used in the industrial process. Calculating or determining the resistance of the dried layer to the vapour flow $R_p$ is a much more complex operation. In addition thereto, the average value of the resistance $R_p$ may change from production lot to production lot due to the differences in the freezing phase and in the freeze-drying cycle owing to the changes in the structure of the dried layer. Even if the same conditions are reproduced the result can be different as the nucleation of the ice (which defines definitively the porosity of the matrix) is an intrinsically stochastic phenomenon and thus the average values of the lot may vary from time to time. In-line monitoring of the resistance value $R_p$ is a difficult task even if some techniques for conducting it have been proposed, for example those disclosed in U.S. Pat. No. 6,643,950.

One widely used technique for monitoring primary drying is the Pressure Rise Test (PRT) disclosed in U.S. Pat. No. 2,994,132.

This technique provides that the valve present in the conduit that connects together the condensation chamber and the drying chamber is closed for a short period time (typically 15-30 seconds) so as to isolate the drying chamber. In this manner, the pressure inside the drying chamber rises as a consequence of the accumulation of vapour at first rapidly and then more slowly when the pressure of the chamber approaches the value of equilibrium with the sublimation interface. The pressure values of the chamber are gathered during the PRT and put in relation with the temperature of the sublimation interface. In U.S. Pat. No. 2,994,132 it was proposed to use the transient pressure response during the PRT to determine the end of primary drying and to calculate the temperature of the product on the basis of the vapour pressure of the ice.

U.S. Pat. No. 6,163,979 discloses a method known as Barometric Temperature Measurement to calculate the temperature of the sublimation interface by using the pressure value for which the first derivative of the pressure rise curve has a maximum.

In addition to graphical methods, in modern monitoring and control systems the use of mathematical models has been proposed for interpreting the pressure rise curve measured during the PRT.

U.S. Pat. No. 6,971,187 discloses a control system in which product status is monitored by using Manometric Temperature Measurement (MTM).

In WO 2008034855 of the same applicant, a control system has been proposed based on a predictive model that uses a different algorithm, known as Dynamic Parameters Estimation (DPE), for monitoring the process.

The main features of these methods can be summarised as follows:

- a single parameter, i.e. the pressure in the drying chamber, is measured during the PRT;
- a mathematical model is used to describe the pressure rise during the PRT;
- an optimization algorithm is used to calculate the temperature of the product on the interface and at the beginning of the test ($T_{i,0}$) and certain system parameters (for example $R_p$ and $K_v$), by seeking the best relationship between the measured pressure and values obtained from the mathematical simulation.

A non-linear least square problem is thus solved:

$$\min_{T_{i,0,parameters}} \sum_k (p_{c,k} - p_{c,meas,k})^2 \quad \text{(eq. 1)}$$

where:

$P_{c,k}$: calculated pressure value in the drying chamber at time $t_k$ (during the PRT);

$p_{c,meas,k}$: measured pressure value in the drying chamber at time $t_k$ (during the PRT).

The simultaneous calculation of $T_{i,0}$ and of the desired parameters nevertheless reduces the accuracy of this method due to the problem of ill-conditioning. This is particularly evident near the end of primary drying when incorrect product temperature values and thus resistance $R_p$ and coefficient $K_v$ values are obtained.

Another drawback of the methods disclosed above, consists of the fact that they are able to monitor only freeze-drying of aqueous solutions or of solutions containing only one solvent. Nevertheless, it should be noted that water is not the only solvent that can be removed by sublimation: various organic solvents have been used for freeze-drying and are generally used mixed with water. A freeze-drying process that uses a system consisting of an organic solvent and water can be advantageous both for the product quality and for optimising the process owing to the rise in sublimation speed (and thus to the decrease in drying time); the use of organic solvents further enables substances and products to be processed that are not soluble or dispersible in water.

In addition to the monitoring methods based on the PRT, the use of measuring sublimation flux has been proposed for monitoring primary drying during a freeze-drying process.

U.S. Pat. No. 6,226,997 discloses the use of a windmill sensor positioned in the conduit that connects the drying chamber and the condensation chamber together to measure the vapour flow.

WO 1995/30118 discloses a method that supplies the value of the sublimation flux by using the pressure measurement at two different points of the apparatus.

US 2006208191 discloses the use of Tunable Diode Laser Absorption Spectroscopy (TDLAS) methods for monitoring primary drying. This technique enables the concentration of water vapour and the speed of the gas in the conduit connecting the drying chamber to the condensation chamber to be measured by using Doppler-shifted near infrared absorption spectroscopy.

When the gas concentration and speed values and the area of the cross section of the conduit are known, it is possible to calculate the vapour flowrate.

In WO 2007/115965, values obtained by means of the absorption spectroscopy are used to determine the local concentration of water in the drying chamber. According to the authors, this value can be correlated with the residual ice content in the product and with sublimation speed.

The values of the sublimation flowrate, which can be integrated over time, if determined with the required accuracy, enable the process to be monitored by determining the total quantity of water removed during the process. The temperature of the product can be calculated by the vapour sublimation flux if the coefficient of heat transfer ($K_v$) between the heating surface and the product in the container is known. This may require a preliminary measurement of the coefficient of heat transfer ($K_v$) to be nevertheless conducted in the same apparatus and by using the same type of container.

Also the resistance of the dried layer to the vapour flow can be determined by using the measured value of the vapour flow if the temperature of the sublimation interface is known, from which it is possible to calculate the partial pressure of the vapour at the interface with the dried layer and thus the pressure difference through the dried layer (once the pressure outside the container is known).

Another drawback of known methods that measure the sublimation flux for monitoring primary drying consists in the complexity, cost and poor reliability of the required instrumentation (windmill flow sensors, laser spectrophotometers, Doppler-effect laser anemometers, etc.) to measure the aforesaid flow of sublimation vapour.

One object of the invention is to improve known methods for monitoring freeze-drying processes, in particular for monitoring the primary drying phase of a freeze-drying process for products, for example pharmaceutical products, arranged in containers or trays.

Another object is to provide a method for monitoring primary drying that enables the variation over time of the temperature of the product and of the thickness of the frozen layer, i.e. of the residual quantity of frozen solvent, to be precisely determined.

A further object is to provide a method for monitoring primary drying that enables operating parameters to be calculated (such as, for example, the coefficient of heat transfer ($K_v$) between the heating surface and the product and the resistance of the dried layer to the vapour flow ($R_p$)) which can be used by model-based control algorithms.

Still another object is to obtain a method that enables the primary drying phase to be monitored also in the case of freeze-drying of a product comprising a mixture of solvents. Another further object is to provide a monitoring method that enables the sublimation flux of a product to be calculated during the primary drying phase in a freeze-drying process, without the need to perform a PRT or to have additional sensors or instrumentation.

A further object is to provide a method that enables the temperature values of the product and other operating parameters of the process to be calculated simply on the basis of measurements of the sublimation flux of the product to be freeze-dried.

According to the invention, a method is provided for monitoring the primary drying phase of a freeze-drying process as defined in claim 22.

Figure 2A:
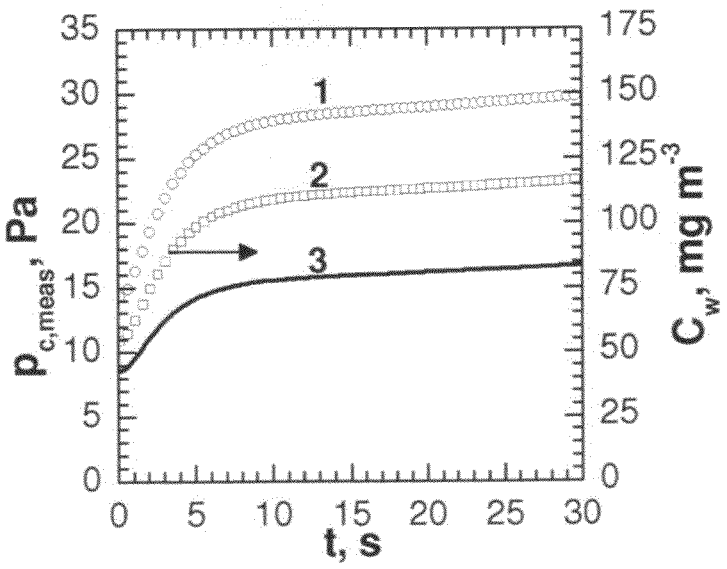
Figure 2B:
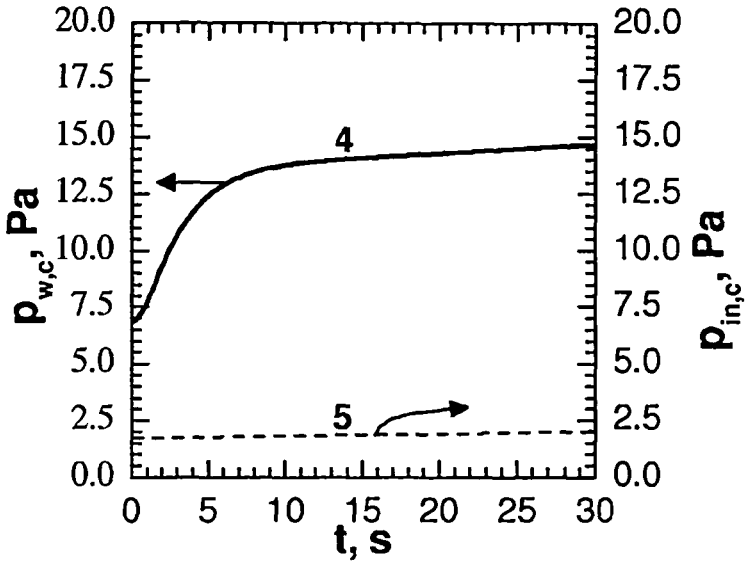

The invention can be better understood and implemented with reference to the attached drawings that illustrate an embodiment thereof by way of non-limiting example, in which:

FIG. 1 is a schematic section view of a container containing a product to be freeze-dried during the primary drying phase of a freeze-drying process, that also shows the system of reference coordinates under consideration;

FIG. 2*a* is a graph that illustrates the use in a drying chamber of different methods for measuring a sublimation flux of the product during the same pressure rise test (use of a laser spectrophotometer usually calibrated in a concentration of the measured solvent (line 2, right axis), and combined use of a thermoconductive or Pirani pressure sensor (line 1) and of a capacitive or Baratron pressure sensor (line 3);

FIG. 2*b* is a graph that illustrates the partial pressure rise curves of water (curve 4) and of an inert gas (nitrogen) (curve 5) obtained from the data in FIG. 2*a;*

Figure 3A:
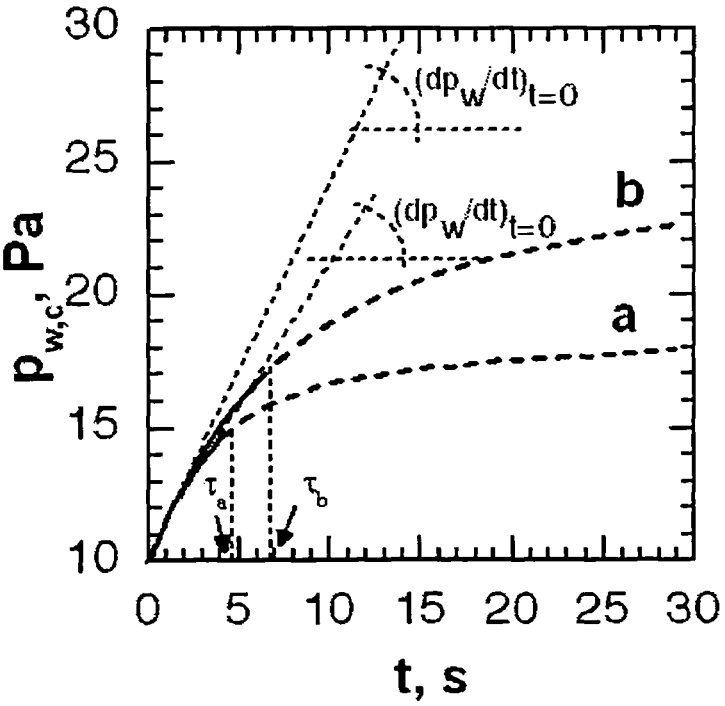
Figure 3B:
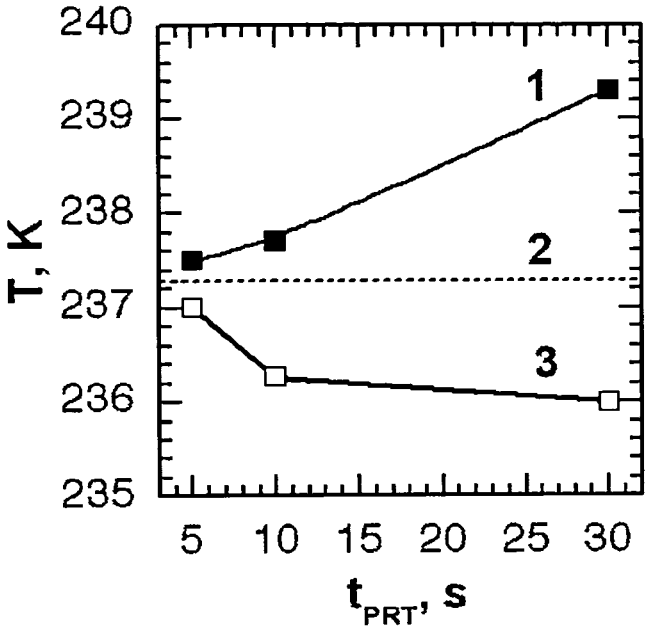
Figure 4A:
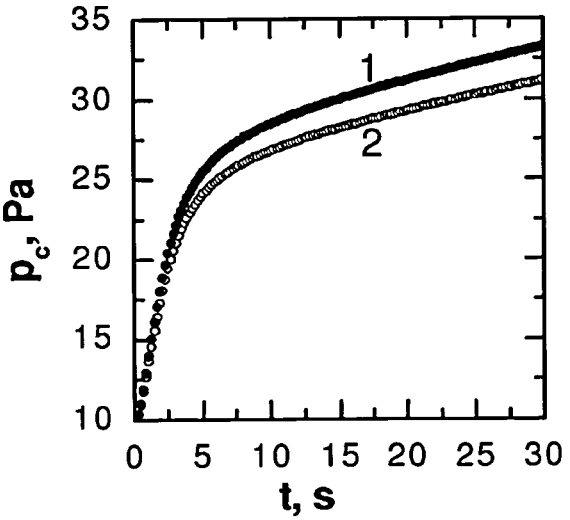
Figure 4B:
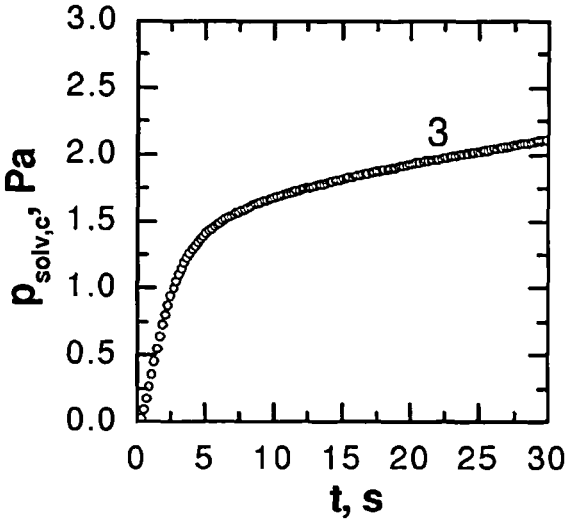

FIG. 3*a* is a graph that illustrates the calculation of the initial slope of the rise curve of the partial pressure of a solvent, at two different times (curves a and b) during the primary drying phase of a 10% by weight sucrose solution, highlighting for both cases the minimum duration of the PRT, corresponding to the characteristic time of the process;

FIG. 3*b* is a graph that illustrates how the estimation of the initial temperature of the sublimation interface varies with the variation of the duration of the PRT (curve 3), the true value of said temperature (curve 2), and the maximum temperature reached by the product during the PRT (curve 1);

FIG. 4*a* is a graph that illustrates the trend of the total pressure rise curve during a PRT caused by the sublimation of water and co-solvent (tert-Butanol) that are present in the product (curve 1) and the trend of the variation of partial pressure of the water (curve 2) measured independently;

FIG. 4*b* is a graph that illustrates the trend of the rise curve of the partial pressure in the chamber of the co-solvent only (curve 3), obtained from the data in FIG. 4*a;*

Figure 5A:
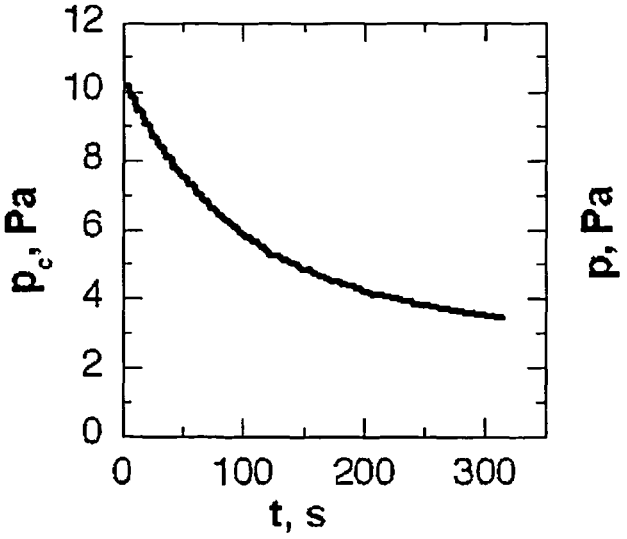
Figure 5B:
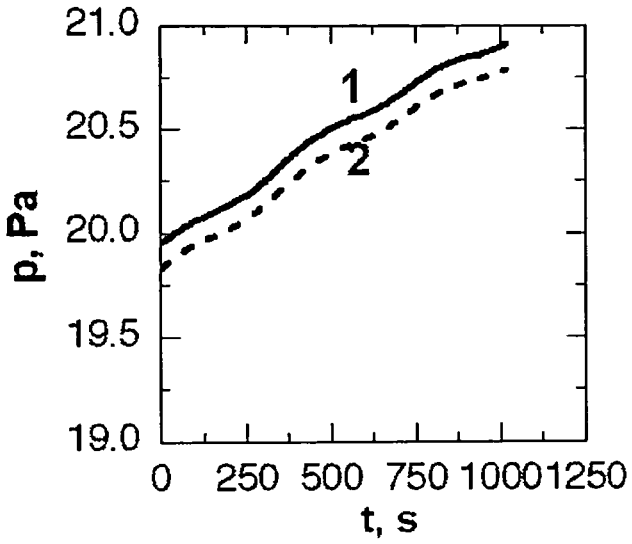
Figure 6:
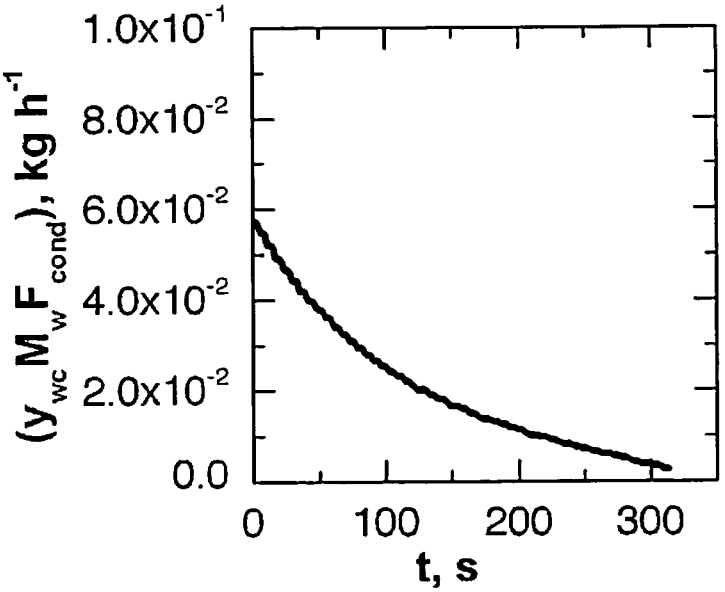

FIG. 5*a* is a graph that illustrates an example of pressure variation in the drying chamber following the stop for a short period of time of the flow of inert gas used to control total pressure in the aforesaid chamber, the curve having been measured during the primary drying phase of a 5% by weight mannitol solution;

FIG. 5*b* is a graph that illustrates an example of pressure variation in the drying chamber (curve 1) and in the condenser (curve 2) following closure of the valve that connects the condenser to the vacuum pump, the results obtained referring to the primary drying phase of a 10% by weight sucrose solution;

FIG. 6 is a graph that illustrates the vapour flowrate exiting from the drying chamber obtained from the pressure curve shown in FIG. 5*a*.

The invention provides a method for monitoring the primary drying phase in a freeze-drying process conducted in a freeze-drying apparatus, which is of known type and is not illustrated, which includes a drying chamber provided with controlled-temperature heating surfaces, and a condensation chamber, the chambers being connected together by a conduit that can possibly be closed by a suitable valve arrangement if they are present.

The monitoring method of the invention is based on associating measurements of the sublimation flux, or of the sublimation flowrate, with the measurements of the pressure variations in the drying chamber. Such variations may be caused by different procedures that are explained in detail below in the description.

The method can be applied both to freeze-drying processes of loose product in trays (bulk freeze-drying) and to freeze-drying processes of product in containers, for example vials (vial freeze-drying). In the description of the method of the invention reference will be made, by way of example, to a vial freeze-drying process as illustrated schematically in FIG. 1. In FIG. 1, in particular, with 1 the layer of dried product is indicated, with 2 the layer of frozen product, with 3 the sublimation flux.

Further on in the description reference will be made to measuring the sublimation flux $j_w$ (kg $s^{-1}$ $m^{-2}$). If the sublimation flowrate $m_w$ (kg $s^{-1}$) is measured, the sublimation flux $j_w$ can be calculated using the following equation:

$$j_w = \frac{m_w}{A_{s,t}} \quad \text{(eq. 2)}$$

where $A_{s,t}$ ($m^2$) is the area of the sublimation interface.

If a Pressure Rise Test (PRT) is used that is conducted by closing the valve in the conduit between the drying chamber and the condenser, in order to cause a variation in the pressure inside the drying chamber, at the start of the PRT the sublimation flux is considered to be known, being measured in line independently (with one of the methods disclosed previously and that will be exemplified below), and the value thereof is equal to $j_{w,0}$ (kg $s^{-1}$ $m^{-2}$).

During the PRT the local evolution of the temperature T=T(z) in the frozen layer can be calculated by means of the following equations:

$$\frac{\partial T}{\partial t} = \frac{\lambda_f}{\rho_f c_{p,f}} \frac{\partial^2 T}{\partial z^2} \text{ for } t > t_0,\ 0 \le z \le L_f \quad \text{(eq. 3)}$$

$$T|_{t_0} = T_{i,0} + \frac{z}{\lambda_f} \Delta H_s j_{w,0} \text{ for } 0 \le z \le L_f \quad \text{(eq. 4)}$$

$$\lambda_f \frac{\partial T}{\partial z}\Big|_{z=0} = \Delta H_s j_w \text{ for } t \ge t_0 \quad \text{(eq. 5)}$$

$$\lambda_f \frac{\partial T}{\partial z}\Big|_{z=L_f} = K_v (T_s - T_b) \text{ for } t \ge t_0 \quad \text{(eq. 6)}$$

where:

T: product temperature, K t: time, s $\lambda_f$: thermal conductivity of the frozen layer, J $s^{-1}m^{-1}k^{-1}$ $\rho_f$: density of the frozen layer, kg $m^{-3}$ $c_{p,f}$: specific heat of the frozen layer, J $kg^{-1}K^{-}$ $t_0$: time at the beginning of the PRT, s z: axial coordinate of the product, m $L_f$: thickness of the frozen layer, m $T_{i,0}$: product temperature at the sublimation interface (z=0) at the beginning of the PRT, K $\Delta H_s$: sublimation heat, J $kg^{-1}$ $K_v$: coefficient of heat transfer between the heating surface and product, J $s^{-1}K^{-1}m^{-2}$ $T_s$: temperature of the heating surface, K $T_b$: product temperature near the base of the container ($z=L_f$), K The heat flows at the sublimation interface (z=0) and the base of the container ($z=L_f$) are not generally the same during the PRT due to the accumulation of energy in the frozen layer, except for an initial phase in which the system can be assumed to be in a stationary condition (i.e. the heat that reaches the product is the same as the heat that is used for sublimation of the solvent). Owing to this consideration, the expression for the coefficient of heat transfer $K_v$, which is assumed to be constant during the PRT, can be differentiated by equaling the boundary conditions (equations eq. 5 and eq. 6), both calculated at the time $t=t_0$. Thus:

$$K_v = \left[\frac{T_s - T_{i,0}}{\Delta H_s j_{w,0}} - \frac{L_f}{\lambda_f}\right]^{-1} \quad \text{(eq. 7)}$$

The preceding equations are completed by the equation that supplies the dynamics of the vapour pressure rise in the drying chamber, said equation consisting of the material balance for the vapour that flows into the chamber:

$$\left(\frac{M_w V_c}{RT_c}\right)\frac{dp_{w,c}}{dt} = A_{s,t}\frac{1}{R_p}(p_{w,i} - p_{w,c}) \quad \text{(eq. 8)}$$

where:

$M_w$: molecular mass of the water (or of the solvent), kg $mol^{-1}$ $V_c$: volume of the drying chamber, $m^3$ R: ideal gas constant, J $K^{-1}mol^{-1}$ $T_c$: temperature of the vapour in the drying chamber, K $A_{s,t}$: total area of the sublimation interface, $m^2$ $R_p$: resistance of the dried layer (and of the stopper, when the product is contained in containers and a stopper is used for closing the containers partially) to the vapour flow, m $s^{-1}$ $p_{w,i}$: vapour pressure of the ice (or of the solvent that sublimates) at the sublimation interface, Pa $p_{w,c}$: partial pressure of the water (or of the solvent that sublimates) in the drying chamber, Pa To solve the equation eq. 8 the values of the vapour pressure at the interface $p_{w,i}$, the temperature of the drying chamber $T_c$ and the resistance of the dried layer $R_p$ are required in addition to the geometrical features of the system (volume of the drying chamber $V_c$, total sublimation area $A_{s,t}$).

The vapour pressure at the interface $p_{w,i}$ is a known function of the product temperature at the interface. The considered reference equation is generally the equation proposed by Goff and Gratch (Goff J. A., Gratch S. 1946. Low-pressure properties of water from −160 to 212 F. Transactions of the American Society of Heating and Ventilating Engineers, 95-122. Presented at the 52nd Annual Meeting of the American Society of Heating and Ventilating Engineers, New York, 1946) for temperatures comprised between −100 and 0° C.:

$$p_{w,i} = 100 \cdot \exp\left[-9.09718\left(\frac{273.16}{T_i} - 1\right) - 3.56654\log_{10}\left(\frac{273.16}{T_i}\right) + + 0.876793\left(1 - \frac{T_i}{273.16}\right) + \log_{10} 6.1071\right] \quad \text{(eq. 9)}$$

This equation supplies values in perfect conformity with those supplied by the International Association for the Properties of Steam (Wanger W., Saul A., Pruss A. 1994. International equations for the pressure along the melting and along the sublimation curve of ordinary water substance. Journal of Physical and Chemical Reference Data, 23, 515-525). For reduced temperature ranges, simpler interpolation functions can be easily obtained.

The partial pressure of the water (or of the solvent) in the drying chamber can be calculated from the total pressure measured during the PRT, considering constant leakage in the chamber and initial partial pressure of inert gases. In fact:

$$p_c = p_{w,c} + p_{in,c} = p_{w,c} + F_{leak} t + p_{in,c,0} \text{ for } t \ge t_0 \quad \text{(eq. 10)}$$

where:

$p_c$: total pressure in the drying chamber, Pa $p_{in,c}$: partial pressure of inert gas in the drying chamber, Pa $p_{in,c,0}$ partial pressure of inert gas in the drying chamber at the beginning of the PRT, Pa $F_{leak}$: rate of pressure rise due to the leakage, Pa $s^{-1}$ and thus:

$$p_{w,c}=p_c-F_{leak}I-p_{in,c,0} \quad \text{(eq. 11)}$$

If the value of the temperature of the vapour in the drying chamber $T_c$ is not available, it can be replaced by the value of the product temperature at the sublimation interface:

$$T_c=T_i \quad \text{(eq. 12)}$$

or by assuming an average value between $T_i$ and $T_s$:

$$T_c=\frac{1}{2}(T_s+T_i) \quad \text{(eq. 13)}$$

The equation eq. 13 can be processed, thus obtaining:

$$T_c=T_i+\frac{1}{2}(T_s-T_i)=T_i\left(1+\frac{1}{2}\frac{T_s-T_i}{T_i}\right)=T_i(1+\varepsilon_s) \quad \text{(eq. 14)}$$

where in general $\epsilon_s<<1$ and thus the equation eq. 12 and the equation eq. 13 are practically equivalent.

With regard to the resistance $R_p$ of the dried layer to the vapour flow, it should be pointed out that in the present method the sublimation flux is measured independently during the primary drying phase and thus at the beginning of the test the value ($j_{w,0}$) thereof is known and thus is equal to:

$$j_{w,0}=\frac{1}{R_p}(p_{w,i,0}-p_{w,c,0}) \quad \text{(eq. 15)}$$

The equation eq. 15 enables $R_p$ to be easily calculated as a function of $j_{w,0}$ (which is measured), of $p_{w,c,0}$ (which is measured), and of which is a function of $T_{i,0}$ according to correlations that are known from the scientific literature (see, for example, the equation eq. 9), which $T_{i,0}$ is in turn the only unknown quantity:

$$R_p=\frac{p_{w,i,0}-p_{w,c,0}}{j_{w,0}} \quad \text{(eq. 16)}$$

Lastly, in order to solve the energy balance equation written for the frozen layer, the thickness of this frozen layer $L_f$ is required. This value can by determined by a material balance equation near the sublimation interface that is solved simultaneously with the preceding equations.

The vapour flow at the interface is the same as the difference between the speed of disappearance of the frozen mass and the speed of formation of the dried mass, according to the following equation:

$$j_w=\rho_f\frac{dL_f}{dt}-\rho_d\frac{dL_f}{dt} \quad \text{(eq. 17)}$$

where $\rho_d$ (kg m$^{-3}$) is the apparent density of the dried layer and $\rho_f$ (kg m$^{-3}$) is the density of the frozen layer. The material balance equation at the interface can be integrated on the interval of time between the previous and the current PRT, obtaining:

$$L_f=L_f^{(-1)}-\frac{1}{(\rho_f-\rho_d)}\int_{t_0^{(-1)}}^{t_0}\frac{1}{R_p}(p_{w,i}-p_{w,c})dt \quad \text{(eq. 18)}$$

where the apex "(−1)" refers to quantities calculated or measured in the previous PRT.

Lastly, the calculated values of the pressure in the drying chamber (which are a function of $T_{i,0}$) are compared with the measured values ($p_{c,meas}$) and the non-linear least-square problem is solved, seeking the value of $T_{i,0}$ that minimises the following objective function:

$$f(T_{i,0})=\sum_k(p_{c,k}-p_{c,meas,k})^2 \quad \text{(eq. 19)}$$

where $p_{c,k}$: calculated value of the total pressure in the drying chamber at the instant k during the PRT, Pa $p_{c,meas,k}$: total pressure in the drying chamber measured at the instant k during the PRT, Pa The steps or phases of the monitoring method of the invention can be summarised as follows:

1. measurement of $j_{w,0}$, $p_{c,0}$ and $p_{w,c,0}$ at the beginning of the PRT;
2. initial estimate of $T_{i0}$;
3. calculation of $p_{w,i}$ (thermodynamic equilibrium at the sublimation interface is assumed) by using equation eq. 9, or similar equations found in the scientific literature;
4. calculation of $R_p$ by using the equation eq. 16;
5. calculation of $L_f$ by using the equation eq. 18 (the values determined or calculated in the case of the first measurement, in the PRT at time $t=t_0^{(-1)}$ are required);
6. calculation of $K_v$ by using the equation eq. 7 (the value of the temperature of the heating surface is required);
7. calculation of the initial temperature profile in the frozen product $T|_{i0}$ by using the equation eq. 4;
8. calculation of the total pressure in the chamber by using the equation eq. 10, if the leaks into the chamber and the partial pressure of inert gases at the beginning of the test are not negligible;
9. integrating the discretised system of ordinary differential equations (ODE) (discretised equation eq. 3 and eq. 8) in the interval of time ($t_0$, $t_f$), where $t_f-t_0$ is the duration of the PRT and calculation of the value $T_{i,0}$ that minimises an objective function f (eq. 19) (solution of an optimization non-linear least-square problem), i.e. which leads to better relationship between the pressure calculated in the chamber $p_c$ and the measured pressure $p_{c,meas}$. The calculation algorithm hypothesises a different $T_{i,0}$ value, repeats the steps 2-7, thus evaluating the function f (eq. 19). The value of $T_{i,0}$ is modified until the minimum of the function f is reached.
10. calculation of the time constant τ of the process:

$$\tau=\frac{V_cM_wR_p}{A_{s,t}RT_{i,0}} \quad \text{(eq. 20)}$$

where:

$V_c$: volume of the drying chamber, m$^3$ $M_w$: molecular mass of the solvent, kg mol$^{-1}$ $R_p$: resistance of the dried layer to vapour flow, m s$^{-1}$ $A_{s,t}$: total area of the sublimation interface, m$^2$ R: ideal gas constant, J $K^{-1}mol^{-1}$ The results obtained from the monitoring method of the invention are:

$T|_{z0}$ temperature of the frozen layer at the beginning of the test;

T=T(z) axial profile or trend of the product temperature during test (by using equations eq. 3-eq. 6);

$L_f$ thickness of the frozen layer;

$R_p$ resistance of the dried layer (and of the stopper when the product is contained in containers and a stopper is used to close partially the latter) to the vapour flow;

$K_v$ coefficient of heat transfer between the heating surface and the product.

Owing to the monitoring method of the primary drying phase of the invention that can associate measuring the sublimation flux with measuring the pressure in the drying chamber it is possible to increase the reliability and the accuracy of the calculations inasmuch as the problem of ill conditioning is solved as only one variable is determined by minimising the function f. Further, this system of monitoring is more stable and is effectively usable until the end of primary drying. Experiments have established that the optimum value of the duration of the PRT corresponds to the time constant τ of the process calculated with the equation eq. 20. Generally, this value is low (a few seconds, for example 5-10 s, FIG. 3*a*) which enables the previously disclosed equations to be significantly simplified. Considering the equation:

$$\left(\frac{M_w V_c}{RT_c}\right)\frac{dp_{w,c}}{dt} = A_{s,t}\frac{1}{R_p}(p_{w,i} - p_{w,c}) \quad \text{(eq. 8)}$$

assuming that $T_c=T_i$ (eq. 12), as discussed previously, and that the product temperature does not increase significantly during the test (which is a consequence of the short duration of the test), we obtain:

$$\frac{M_w V_c R_p}{A_{s,t} RT_{i,0}}\frac{dp_{w,c}}{dt} = p_{w,i,0} - p_{w,c} \quad \text{(eq. 21)}$$

and taking account of the definition of the time constant (τ) we Obtain:

$$\tau\frac{dp_{w,c}}{dt} = p_{w,i,0} - p_{w,c} \quad \text{(eq. 22)}$$

which can be easily solved, obtaining:

$$p_{w,c}=p_{w,c,o}e^{-t/\tau}+p_{w,i,0}(1-e^{-t/\tau}) \quad \text{(eq. 23)}$$

which can be expressed in function of $T_{i,0}$:

$$p_{w,c} = p_{w,c,0}e^{-\frac{A_{s,t}RT_{i,0}j_{w,0}}{M_w V_c(p_{w,i,0}-p_{w,c,0})}t} + p_{w,i,0}\left(1 - e^{-\frac{A_{s,t}RT_{i,0}j_{w,0}}{M_w V_c(p_{w,i,0}-p_{w,c,0})}t}\right) \quad \text{(eq. 24)}$$

The pressure values in the chamber are calculated by using the equation eq. 11:

$$p_c = p_{w,c,0}e^{-\frac{A_{s,t}RT_{i,0}j_{w,0}}{M_w V_c(p_{w,i,0}-p_{w,c,0})}t} + p_{w,i,0}\left(1 - e^{-\frac{A_{s,t}RT_{i,0}j_{w,0}}{M_w V_c(p_{w,i,0}-p_{w,c,0})}t}\right) + F_{leak}t + p_{in,c,0} \quad \text{(eq. 25)}$$

and these values are used, with the measured values, to obtain the function that has to be minimised:

$$f(T_{i,0}) = \sum_k \left[p_{w,c,0}e^{-\frac{A_{s,t}RT_{i,0}j_{w,0}}{M_w V_c(p_{w,i,0}-p_{w,c,0})}t_k} + p_{w,i,0}\left(1 - e^{-\frac{A_{s,t}RT_{i,0}j_{w,0}}{M_w V_c(p_{w,i,0}-p_{w,c,0})}t_k}\right) + F_{leak}t_k + p_{in,c,0} - p_{c,meas,k}\right]^2 \quad \text{(eq. 26)}$$

The results obtained by the monitoring method that uses the simplified equations defined above (eq. 21-eq. 26) are the same as those disclosed above and obtained with the monitoring method defined by the equations eq. 3-eq. 19. The shorter duration the test reduces the rise of the product temperature as shown in FIG. 3*b* (where it is shown how the estimation of the initial temperature of the sublimation interface varies with the variation of the duration of the PRT ($t_{PRT}$), (curve 3), the true value of said temperature (curve 2), and the maximum temperature reached by the product during the test (curve 1) and thus reduces the risk of damaging the product). Further, the simpler formulation of the algorithm enables calculation time to be reduced and a more stable and robust algorithm to be obtained.

Various known techniques can be used to measure the sublimation flux $j_w$, the value of which is used in combination with the PRT according to the monitoring method of the invention. Such techniques measure the vapour flow $j_w$ or of the sublimation flowrate $m_w$ by using, for example:

a) a windmill sensor positioned in the conduit that connects the drying chamber to the condensation chamber;

b) a device exploiting Tunable Diode Laser Absorption Spectroscopy (TDLAS) that is positioned in the conduit that connects the drying chamber to the condensation chamber;

c) using an optical spectrophotometer in the drying chamber;

d) using a moisture sensor that has a fast dynamics (with measurements at different points of the apparatus);

e) using a thermoconductive or Pirani pressure sensor (in addition to a capacitive pressure sensor used to measure total pressure).

Some of these, such as, for example, the techniques a) and b), enable the sublimation flowrate to be measured directly. Other techniques, such as, for example, c) and d) enable the flow of the measurement taken in two appropriate positions to be calculated by estimating the concentration gradient. The sublimation flowrate and flux are linked by the equation eq. 2 and the one can thus be obtained from the other.

By using one of the available techniques to measure directly $j_w$ and by using the algorithms of the method (equations eq. 3-eq. 19 or eq. 21-eq. 26 if the test is short), it is possible to calculate product temperature and the desired parameters ($T|_{t_0}$, T=T(z), $L_f$, $R_p$, $K_v$).

The value of the sublimation flux can also be calculated (independently of the other parameters) from the initial slope of the rise curve of the partial pressure (or concentration) of the solvent measured during the PRT (FIG. 3*a*), by using, for example, techniques c), d) or e) disclosed above. In fact:

$$j_{w,0} = \frac{V_c M_w}{A_{s,t} R T_c} \frac{d p_{w,c}}{dt}\bigg|_{t=t_0} \quad \text{(eq. 27)}$$

and, with the usual assumption given by the equation eq. 12:

$$j_{w,0} = \frac{V_c M_w}{A_{s,t} R T_{i,0}} \frac{d p_{w,c}}{dt}\bigg|_{t=t_0} \quad \text{(eq. 28)}$$

In the case of the pressure measurement, the value of the sublimation flux is an explicit function of $T_{i,0}$, which is a variable calculated by the algorithm.

If the concentration variation of the solvent is measured, for example with a spectrophotometric system, the sublimation flux can be calculated directly without having to estimate the temperature because:

$$j_{w,0} = \frac{V_c}{A_{s,t}} \frac{d C_{w,c}}{dt}\bigg|_{t=t_0} \quad \text{(eq. 29)}$$

where:

$C_{w,c}$: concentration of the water (or of the solvent that sublimates) in the drying chamber, kg $m^{-3}$.

FIGS. 2*a*, 2*b* and 3*a* illustrate the different steps for determining the sublimation flowrate of the product if only one solvent (for example water) is used. In particular, FIG. 2*a* illustrates by way of example the use in a drying chamber of two of the previously mentioned techniques for determining sublimation flux during a pressure rise test, in particular the use of a laser spectrophotometer (line 2) and the combined use of a thermoconductive or Pirani pressure sensor (line 1) and of a capacitive or Baratron pressure sensor (line 3).

In the example shown in FIG. 2*a*, the pressure value measured with the thermoconductive sensor differs from the pressure value supplied by the capacitive sensor. In fact, the measurement of the first sensor is sensitive to the composition of the gas that is the object of the measurement. This sensor is calibrated in an inert atmosphere, so the measuring thereof can be affected by the presence of other gases. In a general freeze-drying process, the gas in the drying chamber consists of a mixture of inert gas and of water vapour. In the case of mixtures of two components, the composition of the gaseous mixture can be obtained by comparing the pressure value supplied by the thermoconductive sensor with the correct value, measured for example by a capacitive sensor.

FIG. 2*b* is a graph that shows the partial pressure rise curves of water (curve 4) and of inert gas (curve 5). The two curves have been calculated by comparing the pressure rise curve acquired by the thermoconductive sensor with the curve supplied by the Baratron sensor.

FIG. 2*a* also shows the curve 2, the variation of the concentration of water ($C_w$), measured directly with an optical spectrophotometer, which enables the sublimation flux to be measured by the equation eq. 29. By applying the state equation of the ideal gases it is of course naturally possible to obtain from the equation the curve of the partial pressure rise of the water, which in the example coincides with the curve 4 calculated with the previously disclosed technique starting from curves 1 and 3.

Naturally, if the initial concentration of inert gas is very small and the leaks are negligible, the preceding methodology can also be applied, with a small error, by using directly the curve of the variation of total pressure in the chamber. In the case of measurements that have a great noise, the pressure data have to be filtered to calculate the slope of the curve.

If the pressure rise signal is delayed, normal process-identifying techniques must be used to calculate the slope of the curve.

In the case of a simplified approach, i.e. in the case of a short PRT, the equation of the function to be minimised (eq. 26) thus becomes, by using the equation eq. 28:

$$f(T_{i,0}) = \sum_k \left[ p_{w,c,0} e^{-\frac{A_{s,t} R T_{i,0}}{M_w V_c (p_{w,i,0} - p_{w,c,0})} \left( \frac{V_c M_w}{A_{s,t} R T_{i,0}} \left( \frac{d p_{w,c}}{dt} \right)_{t=t_0} \right) t_k} + p_{w,i,0} \left( 1 - e^{-\frac{A_{s,t} R T_{i,0}}{M_w V_c (p_{w,i,0} - p_{w,c,0})} \frac{V_c M_w}{A_{s,t} R T_{i,0}} \left( \frac{d p_{w,c}}{dt} \right)_{t=t_0} t_k} \right) + F_{leak} t_k + p_{in,c,0} - p_{c,meas,k} \right]^2 \quad \text{(eq. 30)}$$

Also in this case, the value of $T_{i,0}$ which minimises $f(T_{i,0})$, can be calculated and from this value the desired parameters $T_{i,0}$, $T=T(z)$, $R_p$, $K_v$, $L_f$, can be obtained by using the algorithms of the method (equations eq. 21-eq. 26).

FIG. 3*a* illustrates in particular the graphic calculation of the initial slope of the rise curve of the partial pressure acquired at two different times (indicated with a and b) during the primary drying phase of a 10% by weight sucrose solution. From this slope, the sublimation flowrate can be determined by using the equation eq. 27 or eq. 28.

FIG. 3*a* further shows what is the optimum duration of the PRT in the two cases (indicated respectively with $\tau_a$ and $\tau_b$), which is generally noticeably less than the values used in practice.

It should be observed that, unlike the other known monitoring methods, the method of the invention can be used even if two or more solvents are present simultaneously in the product to be freeze-dried.

In fact, if it is possible to measure separately the contribution to the pressure rise of the various solvents, then the sublimation flux of each solvent can be calculated from the slope of*the partial pressure rise curve:

$$j_{solv,r,0} = \frac{V_c M_{solv,r}}{A_{s,t} R T_{i;0}} \frac{d p_{solv,r,c}}{dt}\bigg|_{t=t_0} \quad \text{(eq. 31)}$$

where:

$j_{solv,r,0}$: sublimation flux of r-th solvent at the start of the PRT, kg $s^{-1}m^{-2}$ $M_{solv,r}$: molecular mass of r-th solvent, kg $mol^{-1}$ $p_{solv,r,c}$: partial pressure of the r-th solvent in the drying chamber, Pa $V_c$: volume of the drying chamber, $m^3$ $M_{solv,r}$: molecular mass of the r-th solvent, kg $mol^{-1}$ $A_{s,t}$: total area of the sublimation interface, $m^2$ R: ideal gas constant, J $K^{-1}mol^{-1}$ $T_{i,0}$: product temperature at the sublimation interface (z=0) at the beginning of the PRT, K t: time, s If there is a direct measurement of the flux (or of the flowrate) of each solvent, this measured value can be used. If the product contains, for example, two solvents, one of which is water, and if the total pressure in the drying chamber and the variation of the partial pressure of one of the two solvents (for example water) is measured—taking into consideration a constant leakage in the chamber and the partial pressure of inert gases—the contribution of the second solvent or co-solvent can be easily calculated from the equation eq. 10 as the difference between total (measured) pressure $p_c$ and the partial pressure of the first solvent (water) $p_{w,c}$:

$$p_{solv,c}=p_c-p_{w,c}-p_{in,c}-F_{leak}t \quad \text{(eq. 32)}$$

where:

$p_{solv,c}$: partial pressure of the co-solvent, Pa $p_c$: total pressure, Pa $p_{w,c}$: partial pressure of the water, Pa $p_{in,c}$: partial pressure of the inert gas, Pa $F_{leak}$: rate of pressure rise due to leakage, Pa $s^{-1}$.

One example of the results that can be obtained using the equation eq. 32 is shown in FIGS. 4*a* and 4*b*.

In particular, FIG. 4*a* is a graph that illustrates the trand of the total pressure rise curve during a PRT caused by the sublimation of water and co-solvent (tert-Butanol) that are present in the product (curve 1) and the trend of the variation in partial pressure of the water (curve 2) measured independently, in the case shown by using a laser spectrophotometer.

FIG. 4*b* is a graph that illustrates the trend of the rise curve of the partial pressure of the co-solvent only (curve 3) obtained by difference.

At this point, as the pressure rise curve of the co-solvent is known, the flow of co-solvent can be calculated directly from the initial slope of the pressure rise curve caused by said co-solvent according to the equation eq. 31, as shown in FIG. 3*a*.

Subsequently, the pressure rise curve due only to the contribution of the water can be interpreted by using the previous algorithm appropriately modified. In particular, the energy balance equation at the sublimation interface has to take account of the energy required for sublimation of the co-solvent. Equations eq. 4, eq. 5 and eq. 7 thus need to be rewritten as follows:

$$T|_{t_0} = T_{i,0} + \frac{z}{\lambda_f}\left(\Delta H_s j_{w,0} + \sum_r \Delta H_{solv,r} J_{solv,r,0}\right) \quad \text{(eq. 33)}$$

for $0 \le z \le L_f$ $$\lambda_f \left.\frac{\partial T}{\partial z}\right|_{z=0} = \Delta H_s j_w + \sum_r \Delta H_{solv,r} j_{solv,r} \text{ for } t \ge t_0 \quad \text{(eq. 34)}$$

$$K_v = \left[\frac{T_s - T_{i,0}}{\Delta H_s j_{w,0} + \sum_r \Delta H_{solv,r} j_{solv,r}} - \frac{L_f}{\lambda_f}\right]^{-1} \quad \text{(eq. 35)}$$

where:

$\Delta H_{solv,r}$: sublimation heat of the r-th co-solvent, J $kg^{-1}$

The preceding equations are completed by the equation that supplies the dynamics of the rise in vapour pressure in the drying chamber, said equation consisting of the material balance for the vapour that flows into the chamber:

$$\left(\frac{M_w V_c}{RT_c}\right)\frac{dp_{w,c}}{dt} = A_{s,t}\frac{1}{R_p}(p_{w,i} - p_{w,c}) \quad \text{(eq. 8)}$$

With regard to the resistance $R_p$ of the dried layer to the water vapour flow, it should be pointed out that in the present method the sublimation flux is measured independently during the primary drying phase and thus at the beginning of the test the value ($j_{w,0}$) thereof is known and further is equal to:

$$j_{w,0} = \frac{1}{R_p}(p_{w,i,0} - p_{w,c,0}) \quad \text{(eq. 15)}$$

The equation eq. 15 enables $R_p$ to be calculated easily as a function of $j_{w,0}$ (which is measured), of $p_{w,c,0}$ (which is measured), and of $p_{w,i,0}$, which is a function of $T_{i,0}$ (eq. 9) which is in turn the only unknown parameter:

$$R_p = \frac{p_{w,i,0} - p_{w,c,0}}{j_{w,0}} \quad \text{(eq. 16)}$$

Naturally, as a consequence of the simultaneous flows of different solvents the $R_p$ values may be different from those evaluated when only one solvent is present.

In order to solve the energy balance equation written for the frozen layer, the thickness of this frozen layer is required. This value can be determined by a material balance equation near the sublimation interface (eq. 17) which is solved simultaneously with the preceding equations.

The material balance equation at the interface can be integrated on the interval of time between the previous and the current PRT, obtaining:

$$L_f = L_f^{(-1)} - \frac{1}{(\rho_f - \rho_d)}\int_{t_0^{(-1)}}^{t_0}\left(\frac{1}{R_p}(p_{w,i} - p_{w,c}) + \sum_r j_{solv,r,0}\right)dt \quad \text{(eq. 36)}$$

where the apex "(−1)" refers to quantities calculated or measured in the previous PRT.

The PRT for pressure rise in the drying chamber (conducted by closing the valve positioned in the conduit that connects the drying chamber and the condensation chamber) is not the only system that the monitoring method of the invention can use to acquire the data necessary to identify the process and seek the best relationship between the measured values and calculated values (using a suitable mathematical model).

It is in fact possible to use other "disturbance" tests in which variations of operating parameters of the freeze-drying process cause a pressure variation (or partial pressure variation) in the drying chamber. For example, it is possible to use the following tests:

a. increasing (or decreasing) the temperature of the heating surface by a certain value (for example 5° C.);
b. increasing (or decreasing) the value set in the pressure controller in the drying chamber;
c. if a controlled flowrate of inert gas is used to control the total pressure in the drying chamber (according to U.S. Pat. No. 3,192,643), stop for a short time the flow of inert gas introduced into the chamber;
d. if the valve is used that connects the condenser to the vacuum pump to maintain and control the pressure of the drying chamber, close said valve for a short interval of time.

The result of these disturbance tests is always a variation of the pressure in the drying chamber, or of the partial pressure of the solvent, which can be measured by suitable sensors such as, for example, some of those disclosed in the previous part, or more simply by a gauge with which the freeze-drying apparatus is always provided.

If the apparatus has a flow measurement device for measuring the flowrate of the inert gas used to control the pressure in the chamber in relation to cases b) and c), this can be used together with or alternatively to the aforementioned pressure sensors.

Some examples of applications of the invention are presented below that are implemented in a pilot freeze-dryer, in particular a Lyobeta 25 freeze-dryer, manufactured by Telstar S.A.

FIG. 5*a* is a graph that shows an example of use of the test specified in point c of the preceding list for primary drying of a 5% by weight mannitol solution: the pressure in the chamber is initially controlled at 10 Pa with the introduction of inert gas, and the reduction curve of the pressure following closure of the valve that controls the flowrate of said inert gas is acquired by the capacitive pressure sensor (Baratron).

FIG. 5*b* is a graph that shows a second and different example, in relation to point d of the preceding list, for primary drying of a 10% by weight sucrose solution: pressure in the chamber is initially approximately 20 Pa, and the rise curve of the pressure in the chamber and in the condenser following closure of the valve that connects the condenser to the vacuum pump are acquired by capacitive pressure sensors (Baratron).

Also in this case a mathematical model of the process is required to calculate the variables (and the parameters) of interest. The aforesaid mathematical model must describe not only the dynamics of the product in the containers but also the dynamics of the entire freeze-drying apparatus. The variables of interest are determined by seeking the best agreement between the measured pressure values and the calculated pressure values of the drying chamber.

In this case the model consists of the equations eq. 3-eq. 6, that constitute the energy balance for the frozen product, with the suitable initial and boundary conditions, whereas the equation eq. 8 is modified to take into account the fact that the chamber is now no longer closed:

$$\left(\frac{M_w V_c}{RT_c}\right)\frac{dp_{w,c}}{dt} = A_{s,t}\frac{1}{R_p}(p_{w,i} - p_{w,c}) - y_{w,c}F_{cond} \qquad \text{(eq. 37)}$$

where:

$F_{cond}$ (mol $s^{-1}$): the total flowrate of gas from the drying chamber to the condensation chamber;

$y_{w,c}$: molar fraction of water inside the drying chamber.

The total flowrate of gas from the drying chamber to the condensation chamber ($F_{cond}$) depends on the features of the apparatus and may, for example, be determined experimentally. Similarly, the equation eq. 10 is modified:

$$\frac{dp_c}{dt} = \frac{dp_{w,c}}{dt} + \frac{dp_{in,c}}{dt} \qquad \text{(eq. 38)}$$

The steps or phases of this version of the monitoring method of the invention can be summarised as follows:

1. measurement of $j_{w,0}$, $p_{c,0}$ and $p_{w,c,0}$ at the beginning of the test;
2. initial estimate of $T_{i0}$;
3. calculation of $p_{w,i}$ (thermodynamic equilibrium at the sublimation interface is assumed) by using the equation Eq. 9 or equivalent equations that are available in the scientific literature;
4. calculation of $R_p$ by using the equation eq. 16;
5. calculation of $L_f$ by using the equation eq. 18 (the values determined or calculated in the case of the first measurement are required, in the test, at time $t=t_0^{(-1)}$);
6. calculation of X., by using the equation eq. 7 (the value of the temperature of the heating surface is required);
7. calculation of the initial temperature profile in the frozen product $T|_{t0}$ by using the equation eq. 4;
8. calculation of the total pressure in the drying chamber by using the equation eq. 38;
9. integration of the discretised system of ordinary differential equations (ODE) (eq. 3-eq. 6, eq. 37, eq. 38) in the interval of time ($t_0$, $t_f$), where $t_f-t_0$ is the duration of the PRT and calculation of the value $T_{i,0}$ that minimises an objective function f (eq. 19) (solution of an optimization non-linear least-square problem), i.e. which leads to the best relationship between the pressure calculated in the chamber $p_c$ and the measured pressure $p_{c,meas}$. The calculation algorithm hypothesises a different value of $T_{i,0}$, repeats the steps 2-7, thus evaluating the function f (eq. 19). The value of $T_{i,0}$ is modified until the minimum of the function f is reached.
10. calculation of the time constant (τ) of the process:

$$\tau = \frac{V_c M_w R_p}{A_{s,t} R T_{i,0}} \qquad \text{(eq. 20)}$$

The results obtained from the monitoring method of the invention are:

$T|_{t_0}$ temperature of the frozen layer at the beginning of the test;

T=T(z) axial profile or trend of the product temperature during the test (using equations eq. 3-eq. 6);

$L_f$ thickness of the frozen layer;

$R_p$ resistance of the dried layer (and of the stopper when the product is contained in containers and a stopper is used to close partially the latter) to the vapour flow;

$K_v$ coefficient of heat transfer between the heating surface and the product.

FIG. 6 is a graph that shows, by way of example, the vapour flowrate exiting the drying chamber calculated from the pressure curve shown in FIG. 5*a*. Said curve has been measured during the primary drying phase of a 5% by weight mannitol solution and is correlatable with the sublimation flux $j_w$ and $j_{w,0}$ by the equations eq. 15, eq. 37 and eq. 38. The results of this method are thus the same as those obtained with the methods based on PRT. Also in this case, the reliability of the calculations is improved by using measurements of the sublimation flux (or of the sublimation flowrate).

Alternatively, also the sublimation flux (or in an equivalent manner the resistance of the dried layer to the vapour flow) can be the object of optimisation [similarly to what is proposed in the case of a PRT by using the algorithm known as the "Dynamic Parameters Estimation" (DPE)] disclosed in WO 2008034855 of the same applicant; in this case the objective function f to be minimised is:

$$f(T_{i,0}, R_P) = \sum_k (p_{c,k} - p_{c,meas,k})^2 \qquad \text{(eq. 39)}$$

A version of the method of the invention is further provided for monitoring the primary drying phase in a freeze-drying process, the method in this case being based only on the measurement of the sublimation flux $j_w$, this measurement being obtained by one of the tests of the variation of the operating parameters (and thus of the pressure inside the drying chamber) disclosed above or by using the PRT.

The aforesaid tests provide the value of the sublimation flux $j_w$ without requiring the use of special sensors to be introduced into the drying chamber or into the conduit (apart from the pressure gauge, which is normally provided in each freeze-drying apparatus and is used, for example, for the PRT) or closing the valve in the conduit that connects the drying chamber to the condensation chamber.

Once the sublimation flux $j_w$ has been calculated indirectly using the equation eq. 28, or by using the equations eq. 15, eq. 37 and eq. 38 if a disturbance other than PRT is used, the sublimation flux $j_w$ can be used for monitoring the freeze-drying process exactly as occurs in the monitoring methods that use windmill sensors or TDLAS sensors, or it can be used, if the pressure variation is known, to calculate the desired parameters $T|_{t_0}$, T=T(z), $L_f$, $R_p$, $K_v$, by using the above-defined equations in the case of (a normal or short) PRT, or in the case of a disturbance test, as already disclosed previously.

The invention claimed is:

1. A method for monitoring a primary drying phase of a freeze-drying process in a freeze-drying apparatus that includes a drying chamber provided with at least one controlled-temperature heating surface for supporting a product to be freeze-dried, said product including at least one solvent, in particular water, said method comprising the following steps:

performing a test that is suitable for causing a variation of partial pressure of solvent inside said drying chamber (step 0);

at the beginning of said test ($t=t_0$) measuring a sublimation flux ($j_{w,0}$) of said product, a total pressure ($p_{c,0}$) in said drying chamber and a partial pressure of said solvent ($p_{w,c,0}$) in said drying chamber (step 1);

estimating a temperature of said product at the interface of sublimation ($T_{i0}$) at the beginning of said test (step 2);

calculating the vapour pressure of said solvent at the interface of sublimation ($p_{w,i}$) (step 3);

calculating a resistance of a dried layer of said product to the vapour flow of said solvent ($R_p$) (step 4);

calculating a thickness of a frozen layer of said product ($L_f$) (step 5);

calculating a coefficient of heat transfer ($K_v$) between the heating surface and the product (step 6);

calculating a temperature profile of the frozen product ($T|_{t0}$) at the beginning of said test (step 7);

calculating a total pressure ($p_c$) in said drying chamber (step 8);

determining a value of the product temperature at the interface of sublimation at the beginning of said test ($T_{i0}$) that best fits the calculated value of the total pressure in the drying chamber ($p_c$) and the measured value of the total pressure in the drying chamber ($p_{c,meas}$) (step 9); and calculating a time constant (t) of the freeze-drying process (step 10), wherein said sublimation flux of said solvent is measured directly, in particular using one between:

a windmill sensor positioned in a conduit connecting said drying chamber to a condensation chamber of the freeze-drying apparatus;

a Tunable Diode Laser Absorption Spectroscopy (TDLAS);

an optical spectrometer in said drying chamber;

a fast-dynamics moisture sensor (with measurements at different points of the apparatus);

a thermal-conducting or Pirani-type pressure sensor in addition to a capacitive pressure sensor used for measuring total pressure.

2. A method according to claim 1, and further comprising, after calculating said time constant (t), the step of calculating (step 11):

temperature of the frozen layer at the beginning of said test ($T|_{t=0}$);

temperature trend (T=T(z)) of said product during said test;

thickness of the frozen layer ($L_f$);

resistance of the dried layer ($R_p$);

coefficient of heat transfer ($K_v$).

3. A method according to claim 2, wherein said initial temperature value of the product frozen layer (T|t=0) at the beginning of said test is calculated by using the equation:

$$T|_{t_0} = T_{i,0} + \frac{z}{\lambda_f}\Delta H_s j_{w,0} \text{ for } 0 \le z \le L_f \quad \text{(eq. 4)}$$

where:

$T|_{t0}$: temperature of the frozen product at the beginning of said test, [K]

$T_{i0}$: temperature of the product at the interface of sublimation at the beginning of said test, [K]

z: axial coordinates in the product thickness, [m]

$l_f$: thermal conductivity of the frozen layer, [J $s^{-1}m^{-1}K^{-1}$].

4. A method according to claim 2, wherein said temperature trend T=T(z) of the product during said test is calculated by using the equations:

$$\frac{\partial T}{\partial t} = \frac{\lambda_f}{\rho_f c_{p,f}}\frac{\partial^2 T}{\partial z^2} \text{ for } t > t_0,\ 0 \le z \le L_f \quad \text{(eq. 3)}$$

$$T|_{t_0} = T_{i,0} + \frac{z}{\lambda_f}\Delta H_s j_{w,0} \text{ for } 0 \le z \le L_f \quad \text{(eq. 4)}$$

$$\lambda_f \frac{\partial T}{\partial t}\bigg|_{z=0} = \Delta H_s j_w \text{ for } t \ge t_0 \quad \text{(eq. 5)}$$

$$\lambda_f \frac{\partial T}{\partial z}\bigg|_{z=L_f} = K_v(T_s - T_b) \text{ for } t \ge t_0 \quad \text{(eq. 6)}$$

where:

T: temperature of the product, [K]

t: time, [s]

$l_f$: thermal conductivity of the frozen layer, [J $s^{-1}m^{-1}K^{-1}$]

$r_f$: density of the frozen layer, [kg $m^{-3}$]

$c_{p,f}$: specific heat of the frozen layer, [J $kg^{-1}K^{-1}$]

$t_0$: time at beginning of test, [s]

z: axial coordinate of the product, [m]

$L_f$: thickness of the frozen layer, [m]

$T|_{t0}$: temperature of the frozen product at the beginning of said test, K $T_{i,0}$: temperature of the product at the interface of sublimation (z=0) at beginning of PRT test, [K]

$DH_s$: heat of sublimation, [J $kg^{-1}$]

$j_{w,0}$: sublimation flux ($j_{w,0}$) of said product at the beginning of the test, [kg $s^{-1}m^{-2}$]

$K_v$: coefficient of heat transfer between heating surface and product, [J $s^{-1}$ $s^{-1}K^{-1}m^{-2}$]

$T_s$: temperature of the heating surface, [K]

$T_b$: temperature of the product near to the bottom of a container of said product ($z=L_f$), [K].

5. A method according to claim 1, wherein said resistance of the dried layer of said product to the vapour flow of said solvent ($R_p$) is calculated by using the equation:

$$R_p = \frac{p_{w,i,0} - p_{w,c,0}}{j_{w,0}} \quad \text{(eq. 16)}$$

where:

$R_p$: resistance of the dried layer to the vapour flow of said solvent, [m $s^{-1}$]

$p_{w,i,0}$: vapour pressure of said solvent at the interface of sublimation at the beginning of said Pa test.

6. A method according to claim 1, wherein said thickness of a frozen layer (Lf) is calculated by using the equation:

$$L_f = L_f^{(-1)} - \frac{1}{(\rho_f - \rho_d)} \int_{t_0^{(-1)}}^{t_0} \frac{1}{R_p}(p_{w,i} - p_{w,c})dt \quad \text{(eq. 18)}$$

where:

$L_f$: thickness of the frozen layer, [m]

$p_{w,i}$: vapour pressure of said solvent at the interface of sublimation, [Pa]

$p_{w,c}$: partial pressure of said solvent in the drying chamber, [Pa]

$r_f$: density of the frozen layer, [kg $m^{-3}$]

$r_d$: apparent density of the dried layer, [kg $m^{-3}$]

$R_p$: resistance of the dried layer to the vapour flow of said solvent, [m $s^{-1}$]

t: time, [s]

$t_0$: time of beginning of test, [s]

and where the apex "−1" refers to quantities calculated or measured at time $t=t_0^{(-1)}$.

7. A method according to claim 1, wherein said coefficient of heat transfer (Kv) is calculated by using the equation:

$$K_v = \left[\frac{T_s - T_{i,0}}{\Delta H_s j_{w,0}} - \frac{L_f}{\lambda_f}\right]^{-1} \quad \text{(eq. 7)}$$

where:

$K_v$: coefficient of heat transfer between heating surface and product, [J $s^{-1}K^{-1}m^{-2}$]

$T_s$: temperature of the heating surface, [K]

$T_{i,0}$: temperature of the product at the interface of sublimation at the beginning of said test, [K]

$DH_s$: heat of sublimation, [J $kg^{-1}$]

$j_{w,0}$: sublimation flux at the beginning of the test, [kg $s^{-1}$ $m^{-2}$]

$L_f$: thickness of the frozen layer, [m]

$l_f$: thermal conductivity of the frozen layer, [J $s^{-1}m^{-1}K^{-1}$].

8. A method according to claim 1, wherein said test that is suitable for causing a variation of partial pressure is a Pressure Rise Test (PRT) in said drying chamber.

9. A method according to claim 8, wherein said total pressure ($p_c$) in said drying chamber is calculated by using the equation:

$$p_c = p_{w,c} + p_{in,c} = p_{w,c} + F_{leak}t + p_{in,c,0} \text{ for } t \geq t_0 \quad \text{(eq. 10)}$$

where:

$p_c$: total pressure in the drying chamber, [Pa]

$p_{w,c}$: partial pressure of said solvent in the drying chamber, [Pa]

$p_{in,c}$: partial pressure of inert gas in the drying chamber, [Pa]

$p_{in,c,0}$: partial pressure of inert gas in the drying chamber at the beginning of the test, [Pa]

t: time, [s]

$F_{leak}$: leakage rate, [Pa $s^{-1}$].

10. A method according to claim 9, wherein said determining a value of the temperature of the product at the interface of sublimation at the beginning of said test ($T_{i0}$) (step 9) further comprises the step of integrating a discretised system of ordinary differential equations (ODE) comprising the following equations in the time interval ($t_0$, $t_f$), where $t_f$–$t_0$ is the time duration of said test:

$$\frac{\partial T}{\partial t} = \frac{\lambda_f}{\rho_f c_{p,f}} \frac{\partial^2 T}{\partial z^2} \text{ for } t > t_0,\ 0 \leq z \leq L_f \quad \text{(eq. 3)}$$

$$\left(\frac{M_w V_c}{RT_c}\right)\frac{dp_{w,c}}{dt} = A_{s,t}\frac{1}{R_p}(p_{w,i} - p_{w,c}) \quad \text{(eq. 8)}$$

where:

T: temperature of the product, [K]

t: time, [s]

$l_f$: thermal conductivity of the frozen layer, [J $s^{-l}m^{-1}K^{-1}$]

$r_f$: density of the frozen layer, [kg $m^{-3}$]

$c_{p,f}$: specific heat of the frozen layer, [J $kg^{-1}K^{-1}$]

$t_0$: time at beginning of PRT, [s]

z: axial coordinate of the product, [m]

$M_w$: molecular mass of said solvent, [kg $mol^{-1}$]

$V_c$: volume of the drying chamber, [$m^3$]

R: ideal gas constant, [J $K^{-1}mol^{-1}$]

$T_c$: temperature of the vapour in the drying chamber, [K]

$A_{s,t}$: area of the interface of sublimation, [$m^2$]

$R_p$: resistance of the dried layer to the vapour flow, [m $s^{-1}$]

$p_{w,i}$: vapour pressure of said solvent at the interface of sublimation, [Pa]

$p_{w,c}$: partial pressure of said solvent in the drying chamber, [Pa].

11. A method according to claim 1, wherein said test that is suitable for causing a variation of partial pressure comprises:

adjusting a temperature of said heating surface by a set value; or adjusting the value set in the controller of the pressure in the drying chamber; or if a controlled flowrate of inert gas is used for controlling total pressure in the drying chamber, stopping for a short time the flow of inert gas introduced into said drying chamber; or if a valve is used that connects a condensation chamber of said freeze-drying apparatus to a vacuum pump for controlling the pressure in said drying chamber, closing said valve for a short interval of time.

12. A method according to claim 11, wherein said total pressure ($p_c$) in said drying chamber is calculated by using the equation:

$$\frac{dp_c}{dt} = \frac{dp_{w,c}}{dt} + \frac{dp_{in,c}}{dt} \quad \text{(eq. 38)}$$

where:

$p_c$: total pressure in the drying chamber, [Pa]

$p_{w,c}$: partial pressure of said solvent in the drying chamber, [Pa]

$p_{in,c}$: partial pressure of inert gas in the drying chamber, [Pa]

t: time, [s].

13. A method according to claim 12, wherein said determining a value of the temperature of the product at the interface of sublimation at the beginning of said test ($T_{i0}$) (step 9)

further comprises the step of integrating a discretised system of ordinary differential equations (ODE) comprising the following equations in the interval of time ($t_0$, $t_f$), where $t_f$–$t_0$ is the time duration of said test:

$$\frac{\partial T}{\partial t} = \frac{\lambda_f}{\rho_f c_{p,f}} \frac{\partial^2 T}{\partial z^2} \text{ for } t > t_0,\ 0 \le z \le L_f \quad \text{(eq. 3)}$$

$$\left(\frac{M_w V_c}{RT_c}\right)\frac{dp_{w,c}}{dt} = A_{S,t}\frac{1}{R_p}(p_{w,i} - p_{w,c}) - y_{w,c}F_{cond} \quad \text{(eq. 37)}$$

where:

T: temperature of the product, [K]

t: time, [s]

$l_f$: thermal conductivity of the frozen layer, [J $s^{-1}m^{-1}K^{-1}$]

$r_f$: density of the frozen layer, [kg $m^{-3}$]

$c_{p,f}$: specific heat of the frozen layer, [J $kg^{-1}K^{-1}$]

$t_0$: time at beginning of PRT, [s]

$M_w$: molecular mass of said solvent, [kg $mol^{-1}$]

$V_c$: volume of the drying chamber, [$m^3$]

R: ideal gas constant, [J $K^{-1}mol^{-1}$]

$T_c$: temperature of the vapour in the drying chamber, [K]

$A_{s,t}$: area of the interface of sublimation, [$m^2$]

$R_p$: resistance of the dried layer to the vapour flow, [m $s^{-1}$]

$p_{w,i}$: vapour pressure of said solvent at the interface of sublimation, [Pa]

$p_{w,c}$: partial pressure of said solvent in the drying chamber, [Pa];

$F_{cond}$: total gas flowrate that goes from the drying chamber to the condensation chamber, [mol $s^{-1}$]

$y_{w,c}$: molar fraction of solvent inside the drying chamber.

14. A method according to claim 10, wherein said determining said value of the temperature of the product at the interface of sublimation at the beginning of said test ($T_{i0}$) (step 9) further comprises, after said integrating, the step of solving a non-linear least-square optimization problem, in particular looking for a value that minimises an objective function (f):

$$f(T_{i,0}) = \sum_k (p_{c,k} - p_{c,meas,k})^2 \quad \text{(eq. 19)}$$

where $p_{c,k}$: calculated value of the total pressure in the drying chamber at the instant k during said test, [Pa]

$p_{c,meas,k}$: measured total pressure in the drying chamber measured at the instant k during said test, [Pa].

15. A method according to claim 13, wherein said determining said value of the temperature of the product at the interface of sublimation at the beginning of said test ($T_{i0}$) (step 9) further comprises, after said integrating, the step of solving a non-linear least-square optimization problem, in particular looking for a value that minimises an objective function (f):

$$f(T_{i,0}) = \sum_k (p_{c,k} - p_{c,meas,k})^2 \quad \text{(eq. 19)}$$

where $p_{c,k}$: calculated value of the total pressure in the drying chamber at the instant k during said test, [Pa]

$p_{c,meas,k}$: measured total pressure in the drying chamber measured at the instant k during said test, [Pa].

16. A method according to claim 10, wherein said time constant (t) of said freeze-drying process is calculated by the equation:

$$\tau = \frac{V_c M_w R_p}{A_{s,t} R T_{i,0}} \quad \text{(eq. 20)}$$

where:

$V_c$: volume of the drying chamber, [$m^3$]

$M_w$: molecular mass of the solvent, [kg $mol^{-1}$]

$R_p$: resistance of the dried layer to the vapour flow, [m $s^{-1}$]

$A_{s,t}$: total area of the interface of sublimation, [$m^2$]

R: ideal gas constant, [J $K^{-1}mol^{-1}$]

$T_{i,0}$: temperature of the product at the interface of sublimation (z=0) at beginning of PRT, [K].

17. A method according to claim 13, wherein said time constant (t) of said freeze-drying process is calculated by the equation:

$$\tau = \frac{V_c M_w R_p}{A_{s,t} R T_{i,0}} \quad \text{(eq. 20)}$$

where:

$V_c$: volume of the drying chamber, [$m^3$]

$M_w$: molecular mass of the solvent, [kg $mol^{-1}$]

$R_p$: resistance of the dried layer to the vapour flow, [m $s^{-1}$]

$A_{s,t}$: total area of the interface of sublimation, [$m^2$]

R: ideal gas constant, [J $K^{-1}mol^{-1}$]

$T_{i,0}$: temperature of the product at the interface of sublimation (z=0) at beginning of PRT, [K].

18. A method according to claim 16, wherein said pressure rise test (PRT) has optimal duration that is substantially equal to said time constant (t).

19. A method for monitoring a primary drying phase of a freeze-drying process in a freeze-drying apparatus that includes a drying chamber provided with at least one controlled-temperature heating surface for supporting a product to be freeze-dried, said product including at least one solvent, in particular water, said method comprising the following steps:

performing a test that is suitable for causing a variation of partial pressure of solvent inside said drying chamber (step 0);

at the beginning of said test ($t=t_0$) measuring a sublimation flux ($j_{w,0}$) of said product, a total pressure ($p_{c,0}$) in said drying chamber and a partial pressure of said solvent ($p_{w,c,0}$) in said drying chamber (step 1);

estimating a temperature of said product at the interface of sublimation ($T_{i0}$) at the beginning of said test (step 2);

calculating the vapour pressure of said solvent at the interface of sublimation ($p_{w,i}$) (step 3);

calculating a resistance of a dried layer of said product to the vapour flow of said solvent ($R_p$) (step 4);

calculating a thickness of a frozen layer of said product ($L_f$) (step 5);

calculating a coefficient of heat transfer ($K_v$) between the heating surface and the product (step 6);

calculating a temperature profile of the frozen product ($T|_{t0}$) at the beginning of said test (step 7);

calculating a total pressure ($p_c$) in said drying chamber (step 8);

determining a value of the product temperature at the interface of sublimation at the beginning of said test ($T_{i0}$) that best fits the calculated value of the total pressure in the drying chamber ($p_c$) and the measured value of the total pressure in the drying chamber ($p_{c,meas}$) (step 9); and calculating a time constant (t) of the freeze-drying process (step 10), wherein said sublimation flux of said solvent is measured indirectly, calculated from pressure measurements inside said drying chamber conducted during said test.

20. A method according to claim 19, wherein the sublimation flux ($j_{w,0}$) of said solvent at the beginning of said PRT is calculated by using the equation:

$$j_{w,0} = \frac{V_c M_w}{A_{s,t} R T_c} \frac{d p_{w,c}}{dt}\bigg|_{t=t_0} \quad \text{(eq. 27)}$$

where:

$V_c$: volume of the drying chamber, [$m^3$]

$M_w$: molecular mass of the solvent, [kg $mol^{-1}$]

$p_{w,c}$: partial pressure of said solvent in the drying chamber, [Pa]

$A_{s,t}$: total area of the interface of sublimation, [$m^2$]

R: ideal gas constant, [J $K^{-1}mol^{-1}$]

$T_c$: temperature of the vapour in the drying chamber, [K]

t: time, [s].

21. A method according to claim 20, wherein said product to be freeze-dried comprises a plurality of solvents and a sublimation flux ($j_{solv,r,0}$) of each solvent at the beginning of said test is calculated by using the equation:

$$j_{solv,r,0} = \frac{V_c M_{solv,r}}{A_{S,t} R T_{i,0}} \frac{d p_{solv,r,c}}{dt}\bigg|_{t=t_0} \quad \text{(eq. 31)}$$

where:

$j_{solv,r,0}$: sublimation flux at the beginning of PRT, [kg $s^{-1}$ $m^{-2}$]

$M_{solv,r}$: molecular mass of the r-th solvent, [kg $mol^{-1}$]

$p_{solv,r,c}$: partial pressure of the r-th solvent in the drying chamber, [Pa]

$V_c$: volume of the drying chamber, [$m^3$]

$A_{s,t}$: total area of the interface of sublimation, [$m^2$]

R: ideal gas constant, [J $K^{-1}mol^{-1}$]

$T_{i,0}$: temperature of the product at the interface of sublimation (z=0) at the beginning of PRT, [K]

t: time, [s].

22. A method according to claim 2, comprising repeating at least steps 0 to 11 at preset intervals.

23. A method comprising performing a primary drying phase of a freeze-drying process for freeze-drying a product to be freeze-dried in a freeze-drying apparatus that includes a drying chamber provided with at least one controlled-temperature heating surface for supporting a product to be freeze-dried, said product including at least one solvent, in particular water, said method comprising during said primary drying phase the following steps:

performing a test that is suitable for causing a variation of partial pressure of solvent inside said drying chamber (step 0);

at the beginning of said test ($t=t_0$) measuring a sublimation flux ($j_{w,0}$) of said product, a total pressure ($p_{c,0}$) in said drying chamber and a partial pressure of said solvent ($p_{w,c,0}$) in said drying chamber (step 1);

estimating a temperature of said product at the interface of sublimation ($T_{i0}$) at the beginning of said test (step 2);

calculating the vapour pressure of said solvent at the interface of sublimation ($p_{w,i}$) (step 3);

calculating a resistance of a dried layer of said product to the vapour flow of said solvent ($R_p$) (step 4);

calculating a thickness of a frozen layer of said product ($L_f$) (step 5);

calculating a coefficient of heat transfer ($K_v$) between heating surface and product (step 6);

calculating a temperature profile of the frozen product ($T|_{t_0}$) at the beginning of said test (step 7);

calculating a total pressure ($p_c$) in said drying chamber (step 8);

determining a value of the product temperature at the interface of sublimation at the beginning of said test ($T_{i0}$) that best fits the calculated value of the total pressure in the drying chamber ($p_c$) and the measured value of the total pressure in the drying chamber ($p_{c,meas}$) (step 9);

calculating a time constant ($\tau$) of the freeze-drying process (step 10), wherein said sublimation flux of said solvent is measured directly, in particular using one between:

a windmill sensor positioned in a conduit connecting said drying chamber to a condensation chamber of the freeze-drying apparatus;

a Tunable Diode Laser Absorption Spectroscopy (TDLAS);

an optical spectrometer in said drying chamber;

a fast-dynamics moisture sensor (with measurements at different points of the apparatus);

a thermal-conducting or Pirani-type pressure sensor in addition to a capacitive pressure sensor used for measuring total pressure.

24. A method for performing a primary drying phase of a freeze-drying process for freeze-drying a product to be freeze-dried in a freeze-drying apparatus that includes a drying chamber provided with at least one controlled-temperature heating surface for supporting a product to be freeze-dried, said product including at least one solvent, in particular water, said method comprising during said primary drying phase the following steps:

performing a test that is suitable for causing a variation of partial pressure of solvent inside said drying chamber (step 0);

at the beginning of said test ($t=t_0$) measuring a sublimation flux ($j_{w,0}$) of said product, a total pressure ($p_{c,0}$) in said drying chamber and a partial pressure of said solvent ($p_{w,c,0}$) in said drying chamber (step 1);

estimating a temperature of said product at the interface of sublimation ($T_{i0}$) at the beginning of said test (step 2);

calculating the vapour pressure of said solvent at the interface of sublimation ($p_{w,i}$) (step 3);

calculating a resistance of a dried layer of said product to the vapour flow of said solvent ($R_p$) (step 4);

calculating a thickness of a frozen layer of said product ($L_f$) (step 5);

calculating a coefficient of heat transfer ($K_v$) between heating surface and product (step 6);

calculating a temperature profile of the frozen product ($T|_{t_0}$) at the beginning of said test (step 7);

calculating a total pressure ($p_c$) in said drying chamber (step 8);

determining a value of the product temperature at the interface of sublimation at the beginning of said test ($T_{i0}$) that best fits the calculated value of the total pressure in the drying chamber ($p_c$) and the measured value of the total pressure in the drying chamber ($p_{c,meas}$) (step 9);

calculating a time constant ($\tau$) of the freeze-drying process (step 10), wherein said sublimation flux of said solvent is measured indirectly, calculated from pressure measurements inside said drying chamber conducted during said test.

* * * * *